US011043185B2

(12) United States Patent
Ko et al.

(10) Patent No.: US 11,043,185 B2
(45) Date of Patent: Jun. 22, 2021

(54) ELECTRONIC DEVICE COMPENSATING PIXEL VALUE OF IMAGE

(71) Applicant: SAMSUNG ELECTRONICS CO., LTD., Suwon-si (KR)

(72) Inventors: Yoonho Ko, Seoul (KR); Jiheon Ok, Wonju-si (KR); Taekon Yu, Hwaseong-si (KR); Hwa Hyun Cho, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/853,007

(22) Filed: Apr. 20, 2020

(65) Prior Publication Data

US 2021/0043158 A1 Feb. 11, 2021

(30) Foreign Application Priority Data

Aug. 5, 2019 (KR) ..... 10-2019-0095005

(51) Int. Cl.
*G09G 5/00* (2006.01)
*G09G 5/18* (2006.01)

(52) U.S. Cl.
CPC ..... *G09G 5/006* (2013.01); *G09G 5/18* (2013.01); *G09G 2310/0272* (2013.01); *G09G 2310/0278* (2013.01); *G09G 2320/0257* (2013.01)

(58) Field of Classification Search
CPC .. G09G 3/3233; G09G 3/3258; G09G 3/3275; G09G 5/003–006; G09G 2320/0233; G09G 2320/0257; G09G 2320/029; G09G 5/006; G09G 5/18
See application file for complete search history.

(56) References Cited

U.S. PATENT DOCUMENTS

| | | | | |
|---|---|---|---|---|
| 9,224,332 | B2 | 12/2015 | Byun et al. | |
| 9,601,058 | B2 | 3/2017 | Lee et al. | |
| 9,721,502 | B2 | 8/2017 | Bi et al. | |
| 2015/0103108 | A1* | 4/2015 | Seong | G09G 3/3208 345/694 |
| 2018/0075798 | A1 | 3/2018 | Nho et al. | |
| 2020/0372860 | A1* | 11/2020 | Kim | H04N 5/57 |

FOREIGN PATENT DOCUMENTS

| | | | |
|---|---|---|---|
| KR | 10-2014-0085739 | A | 7/2014 |
| KR | 10-2017-0081056 | A | 11/2017 |
| KR | 10-2018-0021947 | A | 3/2018 |

* cited by examiner

*Primary Examiner* — Xuemei Zheng
(74) *Attorney, Agent, or Firm* — Lee IP Law, PC

(57) ABSTRACT

An electronic device includes a display driver integrated (DDI) circuit configured to output reference pixel values to be used to obtain target pixel values of a first line, and to output image pixel values associated with a target image; and a panel circuit configured to include the first line that includes pixels configured to display a reference image having the target pixel values, based on the reference pixel values, and a second line that includes pixels configured to display an image corresponding to the target image, based on the image pixel values. The DDI circuit may be further configured to compensate for the image pixel values based on differences between the image pixel values and the reference pixel values.

18 Claims, 8 Drawing Sheets

ELECTRONIC DEVICE COMPENSATING PIXEL VALUE OF IMAGE

CROSS-REFERENCE TO RELATED APPLICATION

Korean Patent Application No. 10-2019-0095005, filed on Aug. 5, 2019, in the Korean Intellectual Property Office, and entitled: "Electronic Device for Compensating Pixel Value of Image," is incorporated by reference herein in its entirety.

BACKGROUND

1. Field

Embodiments relate to an electronic device that compensates a pixel value of an image.

2. Description of the Related Art

With the development of information and communication technology, information associated with various types of images is being distributed. Accordingly, electronic devices such as smart phones include display devices for providing information of an image to a user. As the amount of data that are processed to provide information of the image increases, a display device of high performance is required.

SUMMARY

Embodiments are directed to an electronic device, including a display driver integrated (DDI) circuit configured to output reference pixel values to be used to obtain target pixel values of a first line, and to output image pixel values associated with a target image; and a panel circuit configured to include the first line that includes pixels configured to display a reference image having the target pixel values, based on the reference pixel values, and a second line that includes pixels configured to display an image corresponding to the target image, based on the image pixel values. The DDI circuit may be further configured to compensate for the image pixel values based on differences between the image pixel values and the reference pixel values.

Embodiments are also directed to an electronic device, including a display driver integrated (DDI) circuit configured to schedule an order for determining target pixels to be sensed from among a plurality of pixels, output reference pixel values to the target pixels, and output image pixel values representing a target image; and a panel circuit configured to display noise, based on the reference pixel values, and to display an image corresponding to the target image, based on the image pixel values. The DDI circuit may be further configured to compensate for the image pixel values based on differences between the reference pixel values and the image pixel values.

Embodiments are also directed to an electronic device, including a display driver integrated (DDI) circuit configured to output a reference pixel value to a first pixel and compensate for a first image pixel value to be output to a second pixel, based on the reference pixel value during a first frame, and configured to compensate for a second image pixel value to be output to the first pixel, based on the reference pixel value during a second frame after the first frame; and a panel circuit including the first pixel configured to display noise, based on the reference pixel value during the first frame and to display a first compensation image, based on the second image pixel value during the second frame, and the second pixel configured to display a second compensation image, based on the first image pixel value during the first frame. A pixel value of the noise may be different from a pixel value of the first compensation image, and the pixel value of the noise may be different from a pixel value of the second compensation image.

BRIEF DESCRIPTION OF THE DRAWINGS

Features will become apparent to those of skill in the art by describing in detail example embodiments with reference to the attached drawings in which.

DETAILED DESCRIPTION

In the description, a pixel value means a characteristic value of an image to be displayed or displayed by a pixel. As an example, the pixel value may mean a brightness value of an image to be displayed or displayed by the pixel. Alternatively, the pixel value means the characteristic value (e.g., a threshold voltage value of the pixel) of the pixel associated with the brightness value of the image. In the description, that a signal represents the pixel value means that the signal represents data corresponding to the pixel value.

Figure 1:
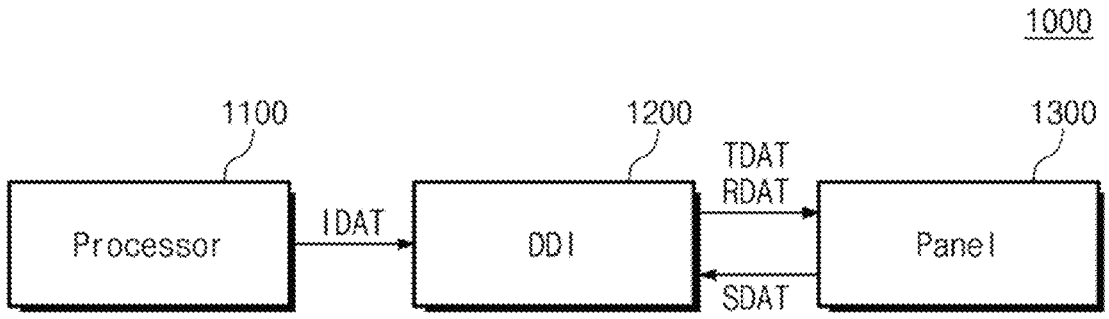
FIG. 1 illustrates a block diagram of an example configuration of an electronic device according to an example embodiment.

FIG. 1 is a block diagram illustrating an example configuration of an electronic device according to an example embodiment.

Referring to FIG. 1, an electronic device 1000 may include a processor 1100, a display driver integrated chip (DDI) 1200, and a panel 1300. The electronic device 1000 may be, for example, one of a personal computer (PC), a workstation, a notebook computer, a mobile device, a wearable device, and the like.

The processor 1100 may control or manage overall operations of components of the electronic device 1000. For example, the processor 1100 may be implemented as a general purpose processor, a dedicated processor, or an application processor. For example, the processor 1100 may include a single processor core or a plurality of processor cores (e.g., a multi-core such as a dual-core, a quad-core, a hexa-core, and the like).

By way of example, the processor 1100 may include a dedicated circuit (e.g., Field Programmable Gate Arrays (FPGAs), Application Specific Integrated Circuits (ASICs, etc.)) including one or more processor cores, or a System on Chip (SoC). For example, the processor 1100 may further include a cache memory located inside or outside thereof.

The processor 1100 may process data associated with the image. For example, the processor 1100 may process the data that represent information of the image to be transferred to a user. As an example, the electronic device 1000 may process (refer to FIG. 13) the data representing information of various types of images, such as information of an image/video obtained by an image sensor, information of the image/video obtained through a communication device, etc.

The panel 1300 may include a pixel array including a plurality of pixels, and a driving circuit for operating the pixel array. The panel 1300 may be configured as, for example, at least one of various types of display structures such as a liquid crystal display (LCD), light emitting diodes (LED), organic light emitting diodes (OLED), and quantum dot light emitting diodes (QLED). The driving circuit of the panel 1300 may include various types of electronic circuits for the operation of the pixel array.

The processor 1100, to transfer information of the image to the user through the panel, may output a signal IDAT indicating data of the image (hereinafter, referred to as image data) to the DDI 1200. The image data may represent, for example, pixel values (hereinafter, referred to as image pixel values) of the image that are displayed by the panel 1300.

The DDI 1200 may receive the signal IDAT from the processor 1100. The DDI 1200 may obtain the image pixel values based on the signal IDAT. The DDI 1200 may perform various controls for the panel 1300 based on the image pixel values. For example, the DDI 1200 may perform a compensation operation on the image pixel values of the signal IDAT and generate a signal RDAT indicating the compensated image pixel values. The DDI 1200 may output the signal RDAT to the panel 1300 to operate the pixels of the panel 1300.

As an example, the DDI 1200 may control the pixels of the panel 1300 based on the signal RDAT such that the image having the image pixel values is displayed by the panel 1300. The signal RDAT may be associated with, for example, a control of operating voltages that are supplied to components (e.g., the pixel, or a thin film transistor (TFT) for operating the pixel) in the panel 1300.

The DDI 1200 may select pixels (hereinafter, referred to as target pixels) to be sensed from among the pixels of the panel 1300. The DDI 1200 may sense and receive pixel values (hereinafter, referred to as target pixel values) of the image that is displayed by the selected target pixels among the pixels of the panel 1300. The DDI 1200 may generate reference data that are used to sense the pixel values of the image that is actually displayed by the target pixels. The reference data may be set, for example, in advance according to the design of the electronic device 1000 (e.g., before the operation of the electronic device 1000 starts, or at the time of designing the electronic device 1000).

The reference data may represent reference pixel values corresponding to the target pixels, respectively. For example, in the electronic device 1000, reference data, which indicate average values of brightness values of the images displayed by the electronic device 1000, may be set as the reference pixel values. Alternatively, the reference pixel values may be set depending on various methods. The DDI 1200 may output a signal TDAT indicating the reference pixel values to the panel 1300.

The pixel array of the panel 1300 may be composed, for example, of lines including the pixels, and the operations (e.g., operation for displaying the image, operation for sensing the pixel values, etc.) of the panel 1300 may performed line by line. The DDI 1200 may output the signal TDAT for controlling the line (hereinafter, referred to as a target line) that includes the target pixels to sense the target pixels. Thus, the DDI 1200 may output the signal TDAT for controlling the target line and the signal RDAT for controlling other lines except for the target line to the panel 1300.

The target pixels may operate based on the signal TDAT. For example, transistors (e.g., transistors for controlling operation of the target pixels) that correspond to the target pixels may be turned on in response to the signal TDAT and may operate based on a voltage/current corresponding to the reference pixel value. Thus, the target pixels may operate to display the image having the reference pixel values of the signal TDAT. As described in further detail below, due to variations of the characteristic values of the pixel and the transistor corresponding to the pixel, the target pixel value of the image that is actually displayed by the target pixels may be different from the reference pixel value.

The target pixels may generate a signal SDAT associated with the image that is actually displayed by the panel 1300. The panel 1300 may output the signal SDAT to the DDI 1200. The DDI 1200 may receive the signal SDAT from the panel 1300. The DDI 1200 may obtain the target pixel values based on the signal SDAT.

The characteristic values (e.g., a threshold voltage of a transistor, mobility, etc.) of the components constituting the panel 1300 may include an inherent variation or error. As an example, the variation may result from process variations that occur during fabricating the panel 1300. Due to variations of the characteristic values, the panel 1300 may display the image having a pixel value different from the image pixel value of the signal RDAT. In some cases, due to variations in the characteristics of components of the panel 1300, an image that includes noise (hereinafter, referred to as a basic noise) may be output.

The DDI 1200 may perform the compensation operation to reduce the basic noise. For example, the compensation operation may include calculation operations based on various algorithms. To perform the calculation operations, the DDI 1200 may include a calculation device such as a processor or various logic circuits, for example. The DDI 1200 may generate compensation data to reduce the basic noise. To obtain the target pixel values (i.e., to sense the image displayed by panel 1300), as the DDI 1200 outputs the signal TDAT to the target pixels, the target pixels may display the image corresponding to the reference pixel value, not the image (i.e., an image corresponding to image data) intended by the processor 1100.

For example, as the target pixels operate based on the reference pixel values of the signal TDAT, the image that is displayed by the target line may display an image that is lighter or darker than the image intended by the processor 1100. Thus, the user may perceive the image displayed by the target line as containing noise. The DDI 1200 may perform the compensation operation to reduce the noise (hereinafter, referred to as a sensing noise) that is perceived by the user due to a sensing operation (i.e., operations for obtaining the target pixel values).

The DDI 1200 may perform the compensation operation on the image pixel values such that the user does not or only slightly perceives the sensing noise.

As an example, the DDI 1200 may compensate image pixel values for other lines adjacent to the target line based on the image pixel values and the reference pixel values. The DDI 1200 may output the signal RDAT indicating the compensated image pixel values. The DDI 1200, rather than actually reducing the noise caused by the image of the target line, may perform compensation operations that reduce the sensing noise perceived by the user by compensating the image of the line adjacent to the target line. Thus, by the compensation operation of the DDI 1200, even though the noise actually generated is not reduced, the noise perceived by the user may be reduced.

As an example, the DDI 1200 may compensate for the image pixel values of a subsequent frame based on the reference pixel values and the image pixel values of a current frame. The DDI 1200, rather than actually reducing the noise caused by the target line in the current frame, may perform the compensation operation to reduce the sensing noise perceived by the user by compensating the image displayed by the target line in the subsequent frame.

As described above, in compensation operations for the sensing noise, the DDI 1200 may compensate for the image pixel value of the line adjacent to the target line in the current frame, or compensate for the image pixel value of the target line in the subsequent frame. Thus, when the image is displayed by the panel 1300, based on the signal RDAT indicating the compensated pixel values, the noise perceived by the user may be decreased.

As described above with reference to FIG. 1, the DDI 1200 may perform the sensing operation to reduce the basic noise from characteristic variations in the panel 1300. To reduce the sensing noise that is generated in performing of the sensing operation, the DDI 1200 may compensate for the image data to be output to the panel 1300. In addition, the DDI 1200 may compensate for the image data to be output to the panel 1300 based on the target data that are obtained by the sensing operation, to reduce the basic noise.

Figure 2:
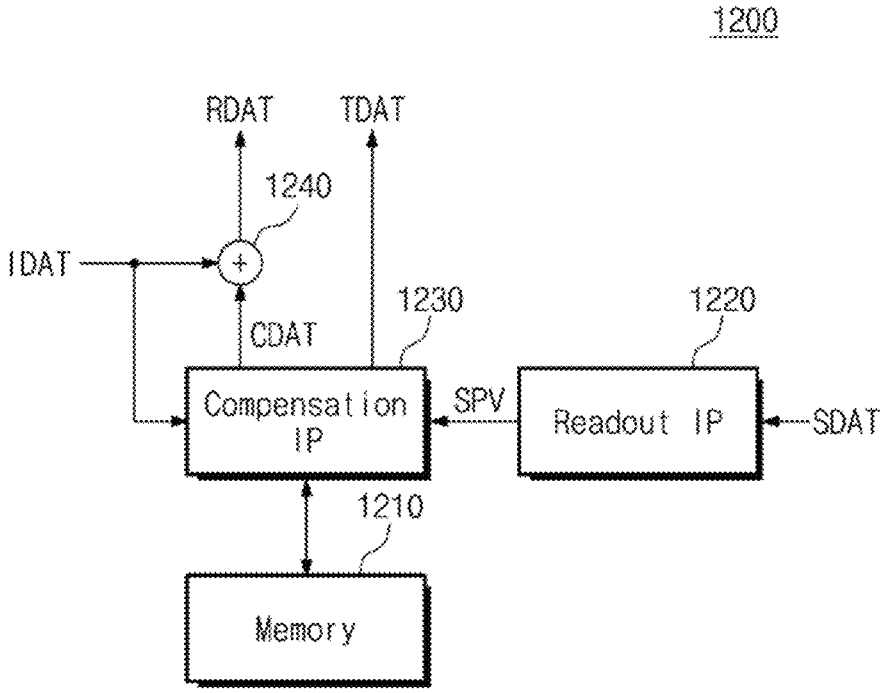
FIG. 2 illustrates a block diagram of an example configuration of the DDI of FIG. 1.

FIG. 2 is a block diagram illustrating an example configuration of the DDI of FIG. 1.

Referring to FIG. 1, the DDI 1200 may include a memory 1210, a readout Intellectual Property (IP) 1220, a compensation IP 1230, and an adder circuit 1240.

The compensation IP 1230 may generate the signal TDAT representing the reference pixel values. The reference pixel values may be set, for example, in the design of the electronic device 1000 and stored in the memory 1210. The compensation IP 1230 may obtain the reference pixel values stored in the memory 1210 and generate the signal TDAT based on the obtained reference pixel values.

Thereafter, the target line of the panel 1300 may operate in response to the signal TDAT and display the image having pixel values corresponding to the reference pixel value. The panel 1300 may output the signal SDAT associated with the image to be actually displayed to the readout IP 1220.

The readout IP 1220 may receive the signal SDAT from the panel 1300. The readout IP 1220 may obtain the target pixel values based on the signal SDAT. For example, the readout IP 1220 may obtain the target pixel value (digital value) by converting the brightness value (analog value) of the image transferred by the signal SDAT. The readout IP 1220 may output a signal SPV representing the target pixel values to the compensation IP 1230.

The compensation IP 1230 may receive the signal SPV from the readout IP 1220. The compensation IP 1230 may obtain the target pixel values based on the signal SPV. The compensation IP 1230 may store the obtained target pixel values in the memory 1210. Thereafter, the compensation IP 1230 may perform the compensation operation to reduce the basic noise based on the target pixel values.

The compensation IP 1230 may receive the signal IDAT from the processor 1100. The compensation IP 1230 may obtain the image pixel values based on the signal IDAT. The compensation IP 1230 may store the image pixel values in the memory 1210. Thereafter, the compensation IP 1230 may perform the compensation operation to reduce the sensing noise based on the reference pixel values and the image pixel values.

For example, the compensation IP 1230 may generate the compensation data for compensating the image data on lines adjacent to the target line based on the reference data and the image data. The compensation IP 1230 may output a signal CDAT representing the compensation data to the adder circuit 1240. The adder circuit 1240 may output the signal RDAT that represents the image data compensated based on the signals IDAT and CDAT. For example, the adder circuit 1240 may output the signal RDAT that represents a sum of the image pixel values of the signal IDAT and the pixel values of the signal CDAT as new image pixel values.

The compensation operations may be performed in a line unit of pixels included in the panel 1300. The compensation IP 1230 may perform scheduling for the compensation operations for the lines. The compensation IP 1230 may perform the compensation operations on the pixels included in the panel 1300 based on a scheduled order.

For example, when one line includes m pixel values, the readout IP 1220 may sequentially obtain the target pixel values that are output from the m target pixels of the target line. When the panel 1300 includes n lines, the DDI 1200 may obtain the pixel values sequentially in the order from a first line to an n-th line of the panel 1300. Thus, the target line may sequentially change from the first line to the n-th line.

A first reference time may be taken to obtain (i.e., the sensing operation is performed) the target pixel values from one target line by the readout IP 1220. The first reference time may be equal to or less than a length of time corresponding to one frame. A second reference time may be taken while the image is displayed by the lines of the panel 1300 in response to the signal RDAT. The first reference time may be longer than the second reference time.

For example, the first reference time may be tens to hundreds of microseconds, and the second reference time may be three microseconds. In this example, while the image corresponding to the reference pixel values is displayed by the target line, the image (i.e., the image that corresponds to the image data transferred from the processor 1100) displayed by the other lines may vary continuously.

To reduce the perception of the sensing noise by the user, the compensation IP 1230 may compensate for the image data of the signal RDAT in real time. Hereinafter, example configurations and operations for compensation of the compensation IP 1230 will be described in more detail with reference to FIG. 3.

Figure 3:
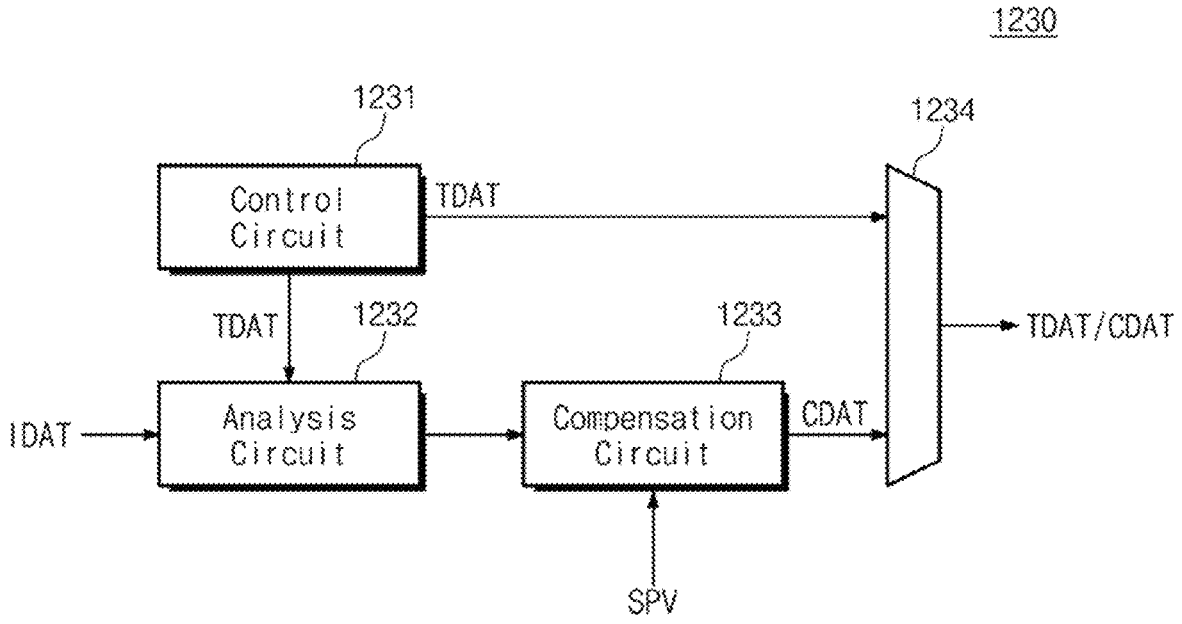
FIG. 3 illustrates a block diagram of an example configuration of a compensation IP of FIG. 2.

FIG. 3 is a block diagram illustrating an example configuration of a compensation IP of FIG. 2.

Referring to FIG. 3, the compensation IP 1230 may include a control circuit 1231, an analysis circuit 1232, a compensation circuit 1233, and a MUX (multiplex) circuit 1234.

The control circuit 1231 may schedule an order of compensation operations for the lines of the panel 1300. For example, as described with reference to FIG. 2, the control circuit 1231 may determine the target line such that the compensation operation is sequentially performed in the order from the first line to the n-th line of the panel 1300 (although it will be appreciated that the control circuit 1231 may perform scheduling to perform the compensation operation based on various orders).

For example, when a third line is determined as the current target line in the order according to the scheduling, the control circuit 1231 may generate the reference pixel values to be output to the third line. The control circuit 1231 may output the signal TDAT representing the reference pixel values to the third line through the MUX circuit 1234. The control circuit 1231 may output the signal TDAT representing the reference pixel values to the analysis circuit 1232.

The analysis circuit 1232 may receive the signal TDAT from the control circuit 1231, and receive the signal IDAT from the processor 1100. The analysis circuit 1232 may obtain the reference pixel values based on the signal TDAT, and obtain the image pixel values, based on the signal IDAT.

The analysis circuit 1232 may calculate the difference values between the obtained pixel values. As an example, the analysis circuit 1232 may calculate the difference values between the reference pixel values on the target line and the image pixel values on a non-target line (e.g., a line adjacent to the target line). As an example, the analysis circuit 1232 may calculate the difference values between the reference pixel values with regard to the target line and the image pixel values. The analysis circuit 1232 may provide the compensation circuit 1233 with the calculated difference values.

The compensation circuit 1233 may receive the difference values from the analysis circuit 1232. As an example, the compensation circuit 1233 may receive the difference values between the reference pixel values and the image pixel values, and calculate the compensation pixel values for compensating the image pixel values, based on the received difference values. The compensation circuit 1233 may output the signal CDAT representing the compensation pixel values to the MUX circuit 1234.

The MUX circuit 1234 may selectively output one of the signal TDAT and the signal CDAT. For example, the MUX circuit 1234 may output the signal TDAT to the panel 1300 to control the pixels of the target line according to the scheduling of the control circuit 1231, or the MUX circuit 1234 may output the signal CDAT to the adder circuit 1240 to control the pixels of lines (e.g., the lines adjacent to the target line) other than the target line according to the scheduling. Example compensation operations of the compensation circuit 1233 for reducing the sensing noise perceived by the user will be described in more detail with reference to FIGS. 4 to 11.

Figure 4:
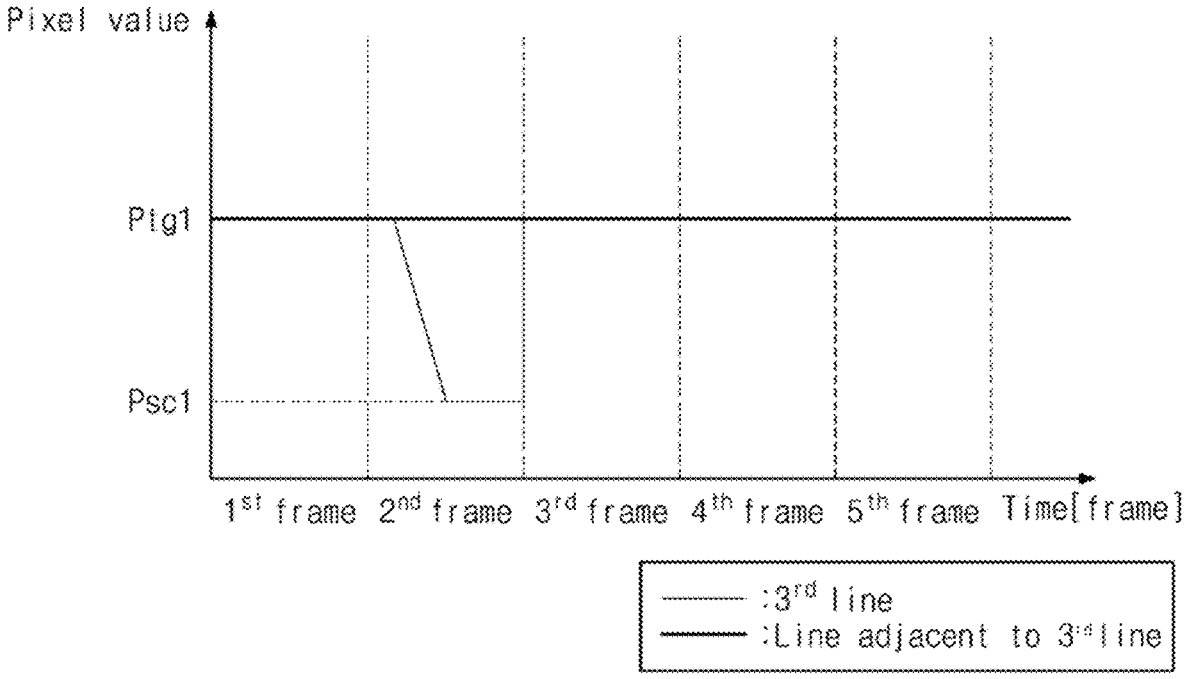
FIG. 4 illustrates a graph describing an example pixel value of an image displayed by a target line.

FIG. 4 is a graph describing an example pixel value of an image displayed by a target line.

In the example of FIG. 4, an x-axis represents a time in a unit of the frame and a y-axis represents pixel values. For a better understanding, the case where the third line is determined as the target line in the second frame will be described, but it will be understood that the target line is a certain line determined in a certain frame based on the scheduling of the control circuit 1231. Referring to FIG. 4, an example (i.e., the case where a relatively bright image is displayed by the image data) in which the pixels of the third line are determined as the target pixels, and the reference pixel values are less than the image pixel value of the third line and the image pixel values of the lines adjacent to the third will be described.

To obtain the target pixel values from the target pixels, the control circuit 1231 may output the signal TDAT representing the reference pixel values to the panel 1300. The target pixels may display the image having the brightness corresponding to the reference pixel value based on the reference pixel values. For example, a sensing operation on the third line may be performed in the second frame. Because the reference pixel value output for the sensing operation is less than the image pixel values output to the third line, the pixel value of the image that is actually displayed by the target pixels in the second frame may decrease from Ptg1 to Psc1.

Accordingly, in the second frame, the panel 1300 may display the image having the pixel value of Psc1 instead of Ptg1. In the second frame, as an image different from the image intended by the processor 1100 is output by the panel 1300, the user may perceive that the sensing noise is included in the image provided by the panel 1300 for the sensing operation. Therefore, by the image output in the second frame, the user may perceive the noise.

After the third frame, because the third line is not selected as the target line, the third line may output the image based on the image pixel value Ptg1. After the third frame, no actual noise may be generated by the third line, but noise may nonetheless be perceived by the user (e.g., noise that is perceived as an afterimage caused for biological reasons).

Figure 5:
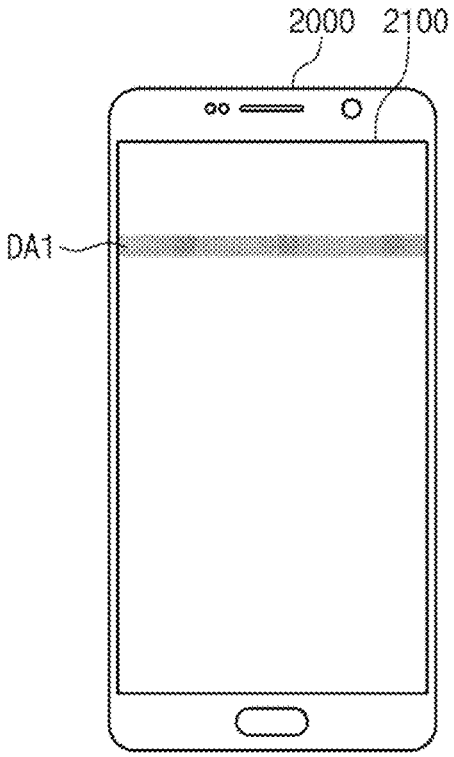
FIG. 5 illustrates a conceptual diagram of an example image displayed by a panel based on a pixel value of FIG. 4.

FIG. 5 is a conceptual diagram illustrating an example image displayed by a panel based on a pixel value of FIG. 4. An electronic device 2000 of FIG. 5 may include the electronic device 1000 of FIG. 1. The electronic device 2000 may include a display area 2100.

The third line of the panel 1300 may display the image corresponding to the reference pixel value for the sensing operation of the DDI 1200. As described with reference to FIG. 4, the pixel value of the image that is displayed by the lines adjacent to the third line may be Ptg1. In this case, as the pixel value of the image that is displayed by the third line of the panel 1300 decreases from Ptg1 to Psc1, the image of an area that corresponds to the third line may be darker than an image of another area in the display area 2100.

In the example of FIG. 5, an area DA1 of the display area 2100 may correspond to the third line. Therefore, the brightness of the image displayed in the area DA1 may be lower than the brightness of the image displayed in another area (e.g., an area adjacent to the area DA1) of the display area 2100. Therefore, the user of the electronic device 2000 may perceive the image displayed in the area DA1 as the sensing noise.

Figure 6:
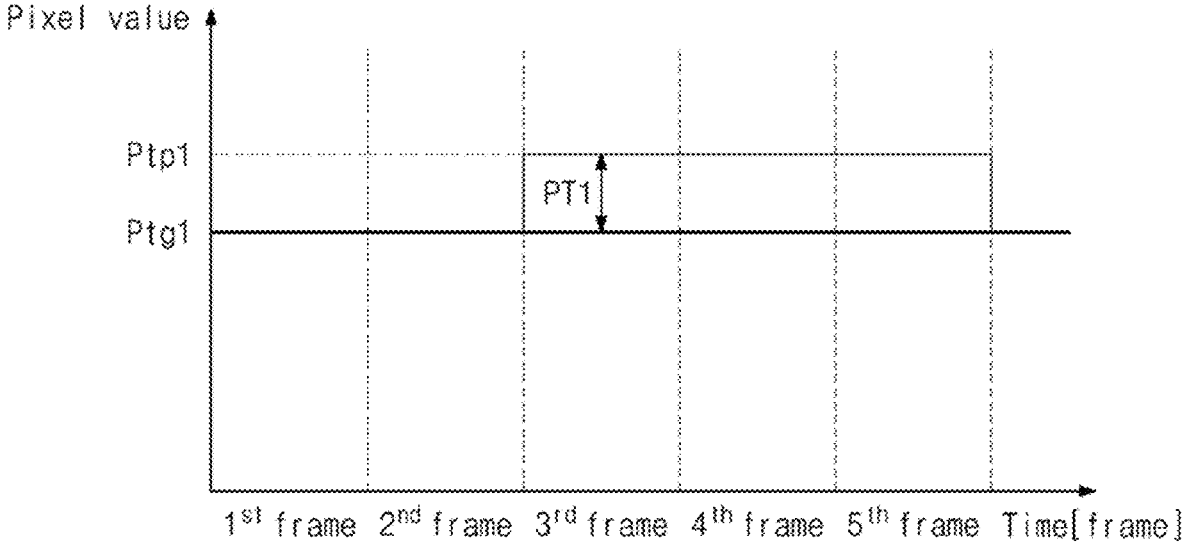
FIG. 6 illustrates a graph describing examples of an image pixel value received by a DDI, and a compensated image pixel value output from a DDI.

FIG. 6 is a graph describing examples of an image pixel value received by a DDI, and a compensated image pixel value output from a DDI. In the example of FIG. 6, an x-axis represents a time in a unit of the frame and a y-axis represents pixel values.

As described with reference to FIG. 2, while the sensing operation is performed, the target line may output the image corresponding to the reference pixel values instead of the image pixel values. In first to fifth frames, the image pixel value of the third line that is obtained based on the signal IDAT may be Ptg1. As described with reference to FIG. 4, as the pixels of the third line operate based on the reference data instead of the image data, the pixel value of the image that is displayed by the third line in the second frame may decrease.

After the third frame, the sensing operation of the DDI 1200 for the third line may end (i.e., the target line may be changed from the third line to another line). As described with reference to FIG. 5, a relatively dark image may be displayed in the area DA1 in the second frame. Due to the afterimage generated by the image (the sensing noise) that is displayed in the area DA1 in the second frame, after the third frame, the user may continuously perceive the sensing noise.

To compensate for noise perceived by the user, the compensation circuit 1233 may generate the compensation pixel values. In an example of FIG. 6, the compensation circuit 1233 may generate the signal CDAT having a compensation pixel value of PT1. Although the embodiment of the signal CDAT output from the third frame to the fifth frame is illustrated in FIG. 6, it will be understood that the length of the time interval in which the signal CDAT is output may vary depending on a design setting.

As the compensation pixel value PT1 is added with the image pixel value by the adder circuit 1240 after the third frame, the third line may operate based on an increased image pixel value. For example, the pixels of the third line may display the image of the increased brightness in response to the signal RDAT. Therefore, the brightness of the image that is displayed in the area DA1 may increase. For example, after the third frame, the brightness of the area DA1 may be higher than the brightness of the area except for the area DA1 of the display area 2100.

Although the example compensation operation of adjusting a reference pixel value during the time interval from a third frame to a fifth frame has been described with reference to FIG. 6, it will be understood that the number of frames on which the adjusted reference pixel value is output may vary. For example, the control circuit 1231 may variously determine the number of frames on which the adjusted reference pixel value is output, and perform the compensation operation of FIG. 6, based on the determined number of frames.

Although the embodiment in which the compensation pixel value PT1 is maintained after the third frame is described with reference to FIG. 6, it will be understood that the compensation pixel value may vary based on the design setting. As an example, the compensation pixel values include various factors (e.g., weight) and may vary depending on changing of the factors. As an example, the compensation pixel value may gradually increase over time.

Figure 7:
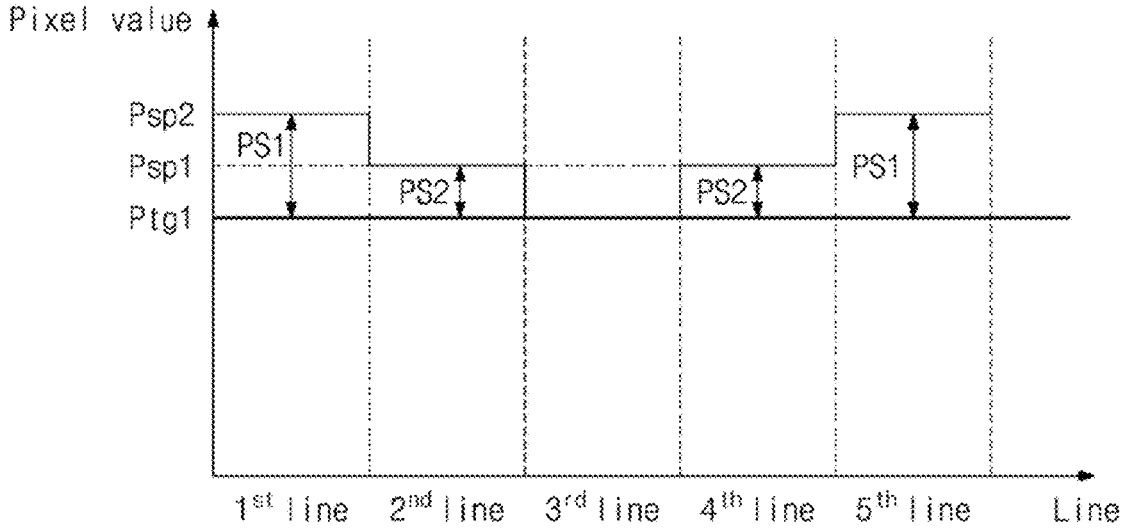
FIG. 7 illustrates a graph describing examples of an image pixel value received by a DDI, and a compensated image pixel value output from a DDI.

FIG. 7 is a graph describing examples of an image pixel value received by a DDI, and a compensated image pixel value output from a DDI. In the example of FIG. 7, an x-axis represents lines of pixels included in the panel 1300 and a y-axis represents a pixel value.

As described with reference to FIG. 2, while the sensing operation is performed, the target line may output the image corresponding to the reference pixel values instead of the image pixel values. For example, for the first to fifth lines, the DDI 1200 may receive the signal IDAT representing an image pixel value of Ptg1. However, for the sensing operation, the DDI 1200 may output the signal TDAT representing the reference pixel values instead of the image pixel values received in the second frame.

To compensate for the image displayed darkly in the area DA1, the compensation circuit 1233 may generate the compensation pixel values for lines adjacent to the third line that is the target line. In the example of FIG. 7, the compensation circuit 1233 may generate the compensation pixel values for the first line, the second line, the fourth line, and the fifth line. The compensation pixel value for the first and fifth lines may be PS1 and the compensation pixel value for the second and fourth lines may be PS2. The compensation circuit 1233 may output the signal CDAT representing compensation pixel values to the adder circuit 1240.

The adder circuit 1240 may add the image pixel values of the signal IDAT and the compensation pixel values of the signal CDAT. Thus, the compensated image pixel value (i.e., the pixel value of the signal RDAT) for the first and fifth lines are Psp2, and the compensated image pixel value (i.e., the pixel value of the signal RDAT) for the second and fourth lines may be Psp1. The adder circuit 1240 may output the signal RDAT representing the image pixel values to which the compensation pixel value is added.

The pixels of the first line, the second line, the fourth line, and the fifth line may operate based on the image pixel values increased by the compensation pixel values. For example, the pixels of the third line may display the image of increased brightness in response to the signal RDAT. Therefore, the brightness of the image displayed in the areas adjacent to the area DA1 increases, and the user may not perceive a relatively low brightness value (the sensing noise) of the area DA1. Thus, noise (i.e., generated as the target pixels of the third line operate based on the reference pixel value) due to the sensing operation of the DDI 1200 may not be perceived by the user.

Although the example compensation operation of adjusting image pixel values of the four lines (the first line, the second line, the fourth line, and the fifth line) is described with reference to FIG. 7, it will be understood that the number of lines that are the target of the compensation operation may vary. For example, the control circuit 1231 may variously determine the number of lines that are the target of the compensation operation and perform the compensation operation on the image pixel values of the determined lines.

Although example embodiments of the compensation pixel values PS1 and PS2 having symmetrical values with respect to the target line are described with reference to FIG. 7, it will be understood that the compensation pixel values may vary depending on the design setting. As an example, the compensation pixel values may include various factors (e.g., weight) and vary as the factors change.

Although an embodiment of the compensation operation for increasing the image pixel value for lines adjacent to the target line is described with reference to FIG. 7, it will be understood that a compensation operation may be performed to reduce the image pixel values for lines adjacent to the target line depending on the design setting.

Figure 8:
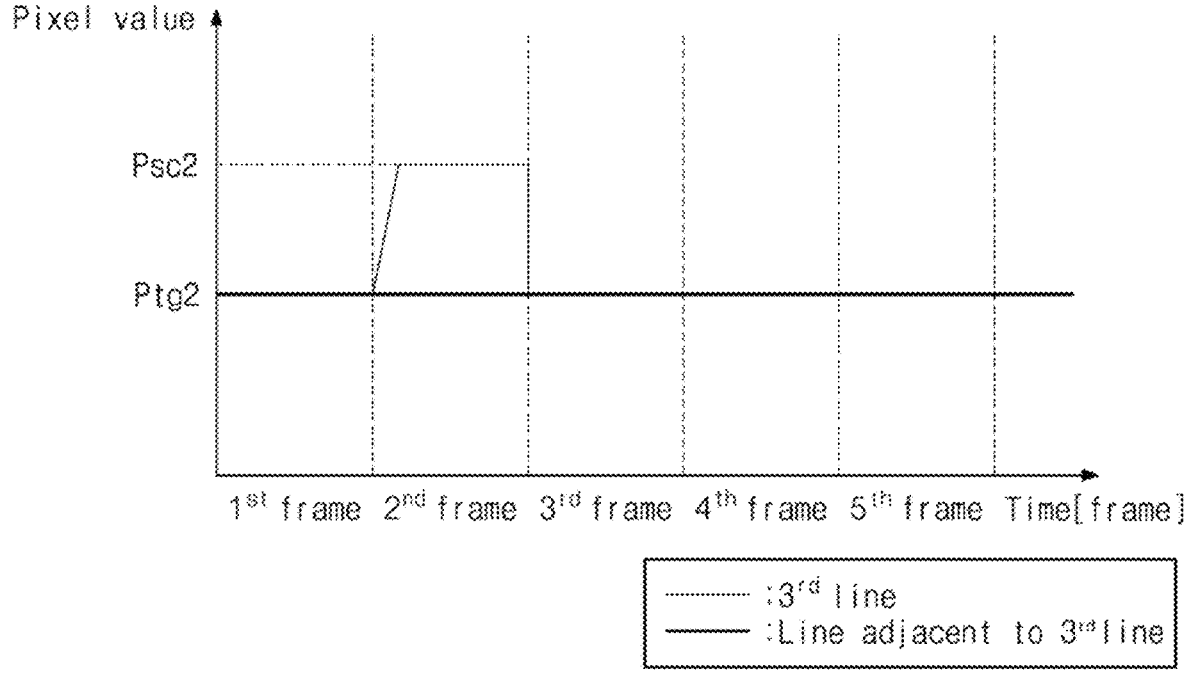
FIG. 8 illustrates a graph describing an example pixel value of an image displayed by a target line.

FIG. 8 is a graph describing an example pixel value of an image displayed by a target line.

In the example of FIG. 8, an x-axis represents a time in a unit of the frame and a y-axis represents a pixel value. For a clear understanding, the case where the third line is determined as the target line in the second frame will be described, but it will be understood that the target line may be a certain line determined in a certain frame based on the scheduling of the control circuit 1231. An example in which the pixels of the third line are determined as the target pixels, and the reference pixel values are greater than the image pixel values for the third line and the lines adjacent to the third line, will be described with reference to FIG. 8.

To obtain the target pixel values from the target pixels, the control circuit 1231 may output the signal TDAT representing the reference pixel values to the panel 1300. The target pixels may display the image having the brightness corresponding to the reference pixel value based on the reference pixel values. For example, the sensing operation on the third line may be performed in the second frame. Because the reference pixel value output for the sensing operation is greater than the image pixel values output to the third line, the pixel value of the image that is actually displayed by the target pixels in the second frame may increase from Ptg2 to Psc2.

Accordingly, the image having a pixel value of Psc2 instead of Ptg2 may be displayed in the second frame by the panel 1300. In the second frame, as an image different from the image intended by the processor 1100 for the sensing operation is output by the panel 1300, the user may perceive that the sensing noise is included in the image provided by the panel 1300. Therefore, the user may perceive noise in the image output in the second frame.

After the third frame, since the third line is not selected as the target line, the third line may output the image, based on the image pixel value Ptg2. After the third frame, no actual noise may be generated but noise may nonetheless be perceived by the user (e.g., noise that is perceived as an afterimage caused by biological reasons).

Figure 9:
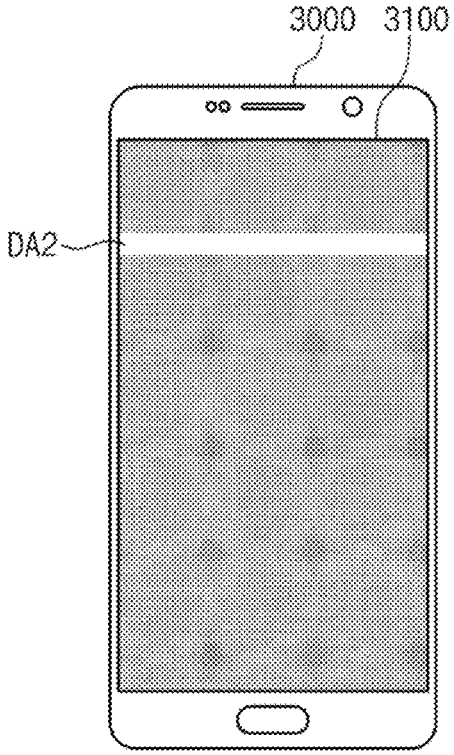
FIG. 9 illustrates a conceptual diagram of an example image displayed by a panel based on a pixel value of FIG. 8.

FIG. 9 is a conceptual diagram illustrating an example image displayed by a panel based on a pixel value of FIG. 8. An electronic device 3000 of FIG. 9 may include the electronic device 1000 of FIG. 1. The electronic device 3000 may include a display area 3100.

The third line of the panel 1300 may display the image corresponding to the reference pixel value for the sensing operation of the DDI 1200. As described with reference to FIG. 8, the pixel value of the image that is displayed by the lines adjacent to the third line may be Ptg2. In this case, as the pixel value of the image displayed by the third line of the panel 1300 increases from Ptg2 to Psc2, the image of an area corresponding to the third line may be brighter than the image of another area in the display area 3100.

In the example of FIG. 9, the area DA2 of the display area 2100 may correspond to the third line. Therefore, the brightness of the image displayed in the area DA2 may be higher than the brightness of the image displayed in another area (e.g., the area adjacent to the area DA2) of the display area 3100. Accordingly, the user of the electronic device 3000 may perceive the image displayed in the area DA2 as having the sensing noise.

Figure 10:
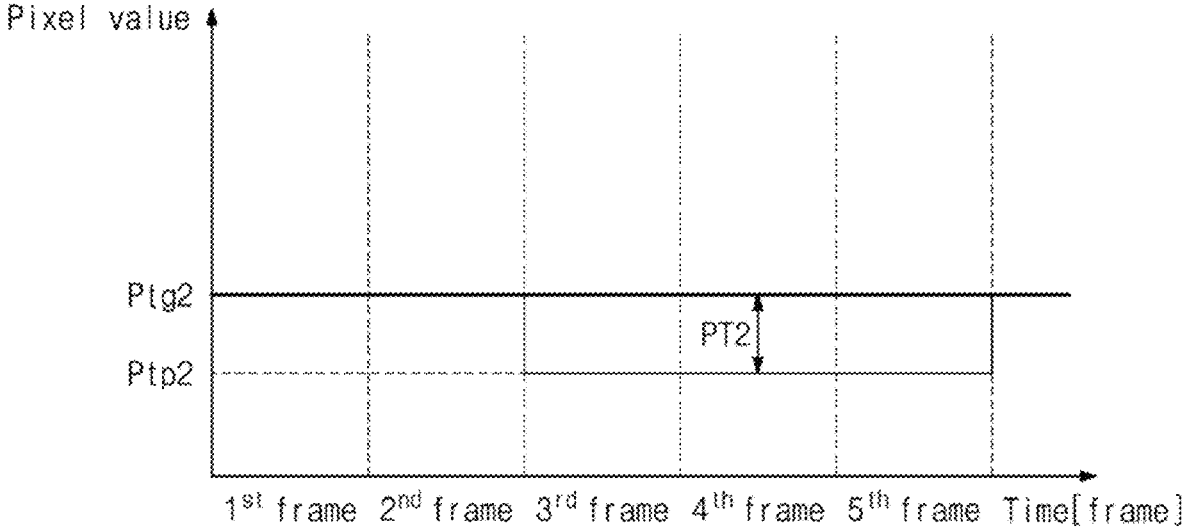
FIG. 10 illustrates a graph describing examples of an image pixel value received by a DDI, and a compensated image pixel value output from a DDI.

FIG. 10 is a graph describing examples of an image pixel value received by a DDI, and a compensated image pixel value output from a DDI. In the example of FIG. 10, an x-axis represents a time in a unit of the frame and a y-axis represents a pixel value.

As described with reference to FIG. 2, while the sensing operation is performed, the target line may output the image corresponding to the reference pixel values instead of the image pixel values. In the first to fifth frames, the image pixel value of the third line that is obtained based on the signal IDAT may be Ptg2. As described with reference to FIG. 8, as the pixels of the third line operate based on the reference data instead of the image data, the pixel value of the image that is displayed by the third line in the second frame may increase.

After the third frame, the sensing operation of the DDI 1200 for the third line may end (i.e., the target line may be changed from the third line to another line). As described with reference to FIG. 5, a relatively dark image may be displayed in the area DA1 in the second frame. After the third frame, the user may continuously perceive the sensing noise due to the afterimage that is generated by the image (the sensing noise) displayed in the area DA1 in the second frame.

To compensate for the noise perceived by the user, the compensation circuit 1233 may generate the compensation pixel values. In the example of FIG. 10, the compensation circuit 1233 may generate the signal CDAT having a compensation pixel value of PT2. Although the embodiment of the signal CDAT output from the third frame to the fifth frame is illustrated in FIG. 10, it will be understood that the length of the time interval in which the signal CDAT is output may vary.

As the compensation pixel value PT2 is added with the image pixel value by the adder circuit 1240 after the third frame, the third line may operate based on the reduced image pixel value. For example, the pixels of the third line may display the image of the reduced brightness in response to the signal RDAT. Therefore, the brightness of the image displayed in the area DA2 may decrease. For example, after the third frame, the brightness of the area DA2 may be lower than the brightness of the area except for the area DA2 of the display area 3100.

Although the example compensation operation of adjusting a reference pixel value during a time period from a third frame to a fifth frame has been described with reference to FIG. 10, it will be understood that the number of frames to which the adjusted reference pixel value is output may vary. For example, the control circuit 1231 may variously determine the number of frames to which the adjusted reference pixel value is output, and perform the compensation operation of FIG. 10 based on the determined number of frames.

Although an embodiment in which the compensation pixel value PT2 is maintained after the third frame is described with reference to FIG. 10, it will be understood that the compensation pixel value may be variously changed depending on a design setting. As an example, the compensation pixel values may include various factors (e.g., the weight) and vary as the factors change. For example, the compensation pixel value may gradually decrease as the frame elapses.

Figure 11:
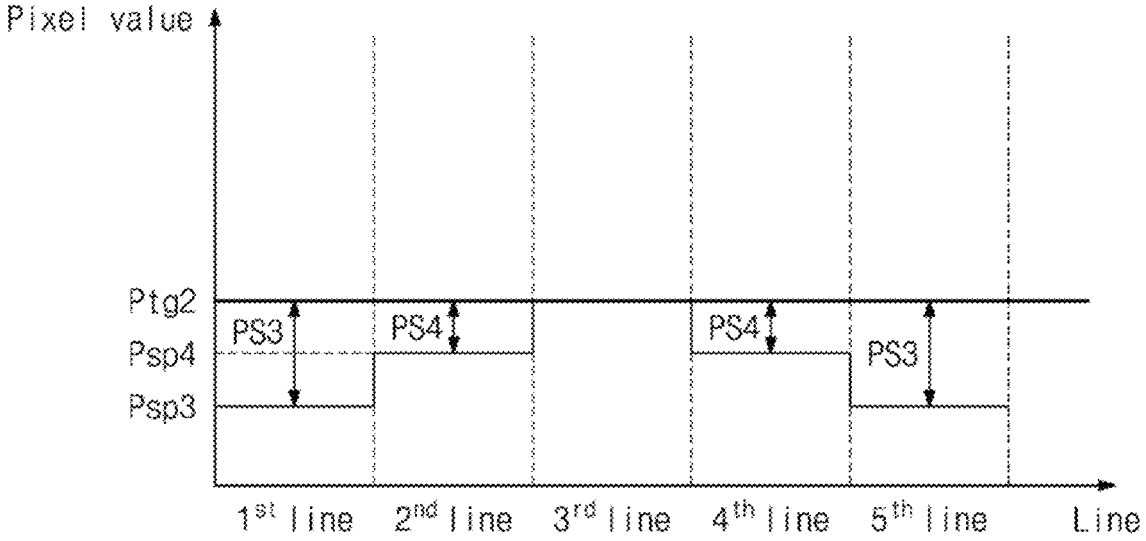
FIG. 11 illustrates a graph describing examples of an image pixel value received by a DDI, and a compensated image pixel value output from a DDI.

FIG. 11 is a graph describing examples of an image pixel value received by a DDI, and a compensated image pixel value output from a DDI. In the example of FIG. 11, an x-axis represents lines of pixels included in the panel 1300, and a y-axis represents the pixel value.

As described with reference to FIG. 2, while the sensing operation is performed, the target line may output the image corresponding to the reference pixel values instead of the image pixel values. For example, for the first to fifth lines, the DDI 1200 may receive the signal IDAT representing the image pixel value of Ptg2. However, for the sensing operation, the DDI 1200 may output the signal TDAT representing the reference pixel values instead of the image pixel values received in the second frame.

To compensate for the image displayed relatively brightly in the area DA2, the compensation circuit 1233 may generate the compensation pixel values. In the example of FIG. 11, the compensation circuit 1233 may generate the compensation pixel values for the first line, the second line, the fourth line, and the fifth line. The compensation pixel value for the first and fifth lines may be PS3, and the compensation pixel value for the second and fourth lines may be PS4. The compensation circuit 1233 may output the signal CDAT representing the compensation pixel values to the adder circuit 1240.

The adder circuit 1240 may add the image pixel values of the signal IDAT to the compensation pixel values of the signal CDAT. The adder circuit 1240 may output the signal RDAT representing the image pixel values to which the compensation pixel value is added. Accordingly, the compensated image pixel value (i.e., the pixel value of the signal RDAT) for the first line and the fifth line may be Psp3, the compensated image pixel value (i.e., the pixel value of the signal RDAT) for the second line and the fourth line (i.e., the pixel value of the signal RDAT) may be Psp4.

The pixels of the first line, the second line, the fourth line, and the fifth line may operate based on the image pixel values that is decreased by the compensation pixel values. For example, the pixels of the second line may display the image of a relatively decreased brightness in response to the signal RDAT. Therefore, the brightness of the image that is displayed in the areas adjacent to the area DA2 may decrease, and the user may not perceive a relatively high brightness value (the sensing noise) of the area DA2. Accordingly, the noise (i.e., noise generated by the target pixels of the third line operating based on the reference pixel value) due to the sensing operation of the DDI 1200 may not be perceived by the user.

Although an example compensation operation of adjusting image pixel values of the four lines (the first line, the second line, the fourth line, and the fifth line) is described with reference to FIG. 11, it will be understood that the number of lines that are target of the compensation operation may vary. For example, the control circuit 1231 may variously determine the number of lines that are the target of the compensation operation, and perform the compensation operation for the image pixel values of the determined lines.

Although embodiments of the compensation pixel values PS3 and PS4 having symmetrical values with respect to the target line are described with reference to FIG. 11, it will be understood that the compensation pixel values may be variously changed depending on the design setting. As an example, the compensation pixel values include various factors (e.g., weight) and may vary as the factors change.

Although an embodiment of the compensation operation that decreases the image pixel value for lines adjacent to the target line is described with reference to FIG. 11, it will be understood that a compensation operation may be performed to increase image pixel values for lines adjacent to the target line, depending on the design settings.

Figure 12:
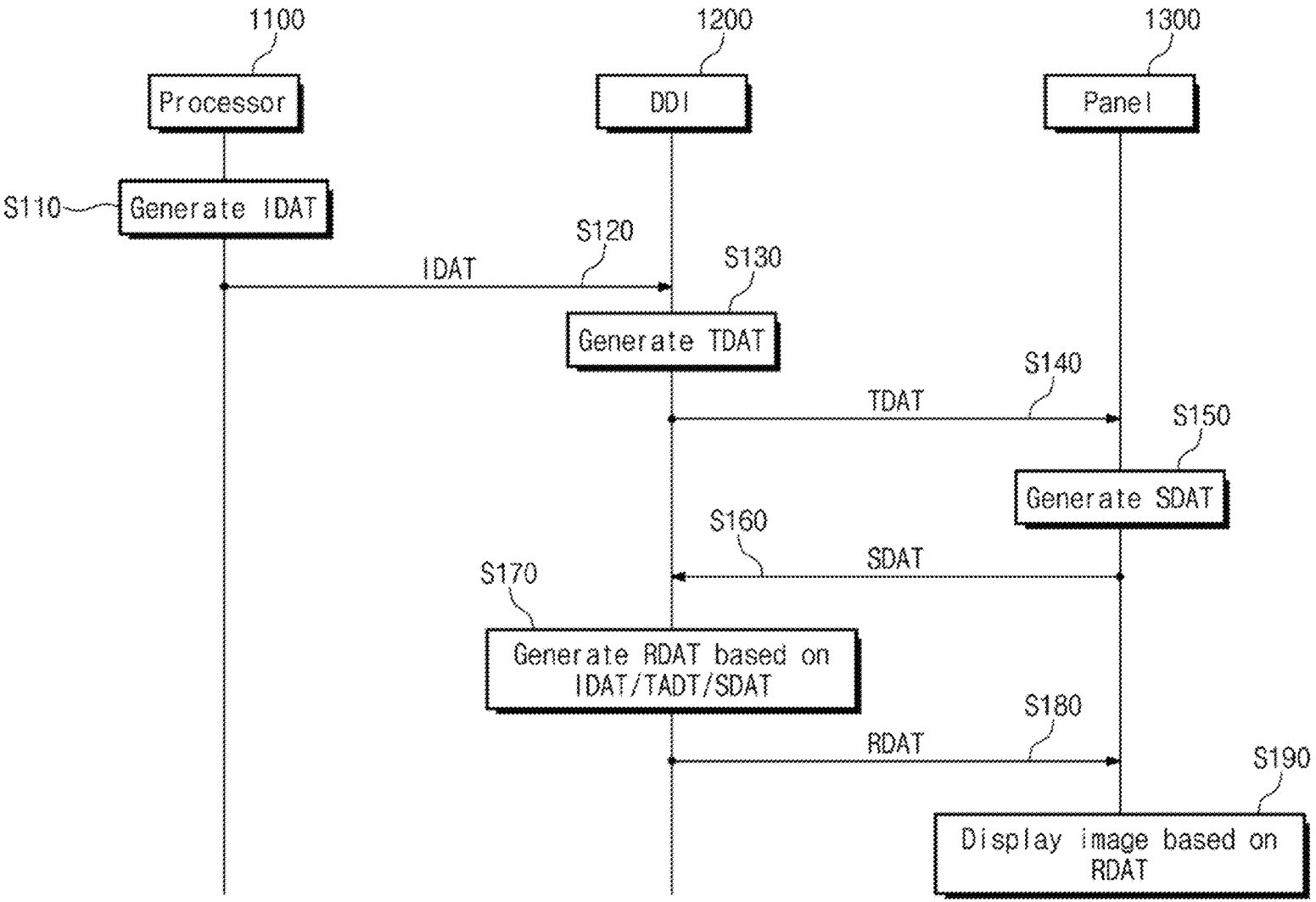
FIG. 12 illustrates a flowchart describing example operations of an electronic device of FIG. 1.

FIG. 12 is a flowchart describing example operations of an electronic device of FIG. 1.

In operation S110, the processor 1100 may generate the image data representing the image pixel values. For example, the image data may be associated with various types of images or videos. The processor 1100 may generate the signal IDAT representing the image data.

In operation S120, the processor 1100 may output the signal IDAT to the DDI 1200.

In operation S130, the DDI 1200 may generate the reference pixel values that are used to obtain the target pixel values from the target pixels. The DDI 1200 may generate the signal TDAT representing the reference pixel values.

In operation S140, the DDI 1200 may output the signal TDAT to the panel 1300.

In operation S150, the panel 1300 may display the image corresponding to the reference pixel value based on the signal TDAT. The panel 1300 may generate the signal SDAT representing the image (i.e., the image including the basic noise) that is actually displayed based on the reference pixel value.

In operation S160, the panel 1300 may output the signal SDAT to the DDI 1200.

In operation S170, the DDI 1200 may generate the compensation pixel values to compensate for the image pixel values that are obtained based on the signal IDAT. To reduce the basic noise generated by the components of the panel 1300, the DDI 1200 may generate the compensation pixel values based on the target pixel values of the signal SDAT.

In addition, to reduce the sensing noise perceived by the user, the DDI 1200 may generate the compensation pixel values based on the difference between the reference pixel values of the signal TDAT and the image pixel values. The DDI 1200 may compensate for the image pixel values by using the compensation pixel values, and generate the signal RDAT representing the compensated image pixel values. For example, the DDI 1200 may generate the signal RDAT that represents the sum of the image pixel values and the compensation pixel values as a new image pixel value.

In operation S180, the DDI 1200 may output the signal RDAT to the panel 1300.

In operation S190, the panel 1300 may display the image based on the signal RDAT. The frame on which operation S190 is performed may be different from the frame on which operation S150 is performed. For example, after operation S150 is performed during the first frame, operation S190 may be performed during the second frame subsequent to the first frame. Since the signal RDAT represents the compensated image data, the image displayed based on the signal RDAT may include a relatively small amount of the basic noise, and the user may not perceive or weakly perceive the sensing noise.

For better understanding, although operations S120 to S190 are illustrated to be performed after operation S110 is performed, it will be understood that operation S110 may be performed in any order before operation S170.

Figure 13:
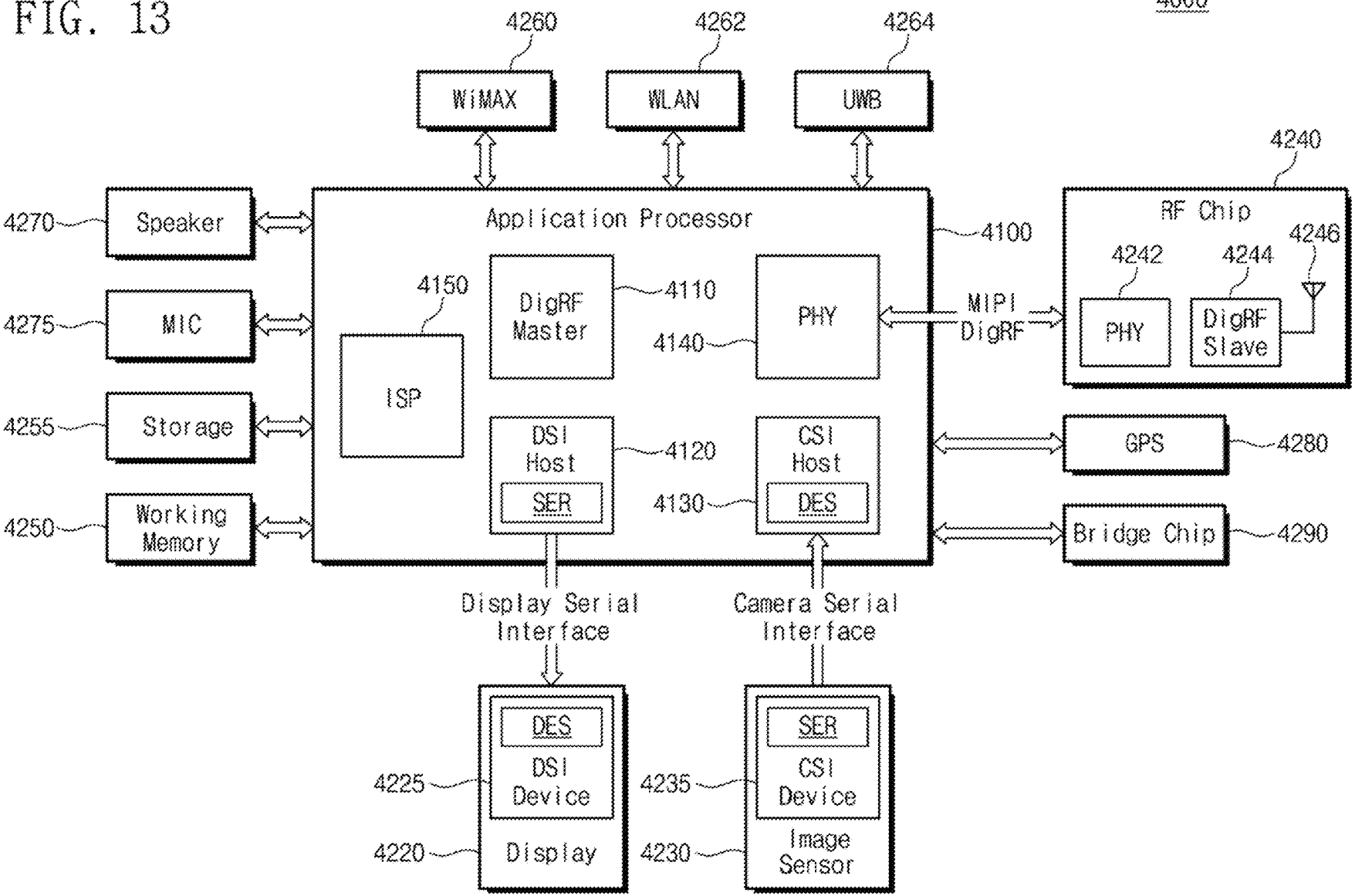
FIG. 13 illustrates a block diagram of an example electronic device according to an example embodiment.

FIG. 13 is a block diagram illustrating an example electronic device according to an example embodiment.

An electronic device 4000 of FIG. 13 may include at least one of the electronic device 1000 of FIG. 1, the electronic device 2000 of FIG. 5, and the electronic device 3000 of FIG. 9. The electronic device 4000 may be implemented as a data processing device capable of using or supporting the interface protocol proposed by the MIPI federation. For example, the electronic device 4000 may be one of electronic devices such as a portable communication terminal, a personal digital assistant (PDA), a portable media player (PMP), a smartphone, a tablet computer, a wearable device, and the like.

The electronic device 4000 may include an application processor 4100, a display device 4220, and an image sensor 4230. For example, the application processor 4100 may include the processor 1100 of FIG. 1. The application processor 4100 may include a DigRF master 4110, a Display Serial Interface (DSI) host 4120, a Camera Serial Interface (CSI) host 4130, and a physical layer 4140.

The display device 4220 may include the DDI 1200 and the panel 1300 of FIG. 1. The display device 4220 may display the image based on the image data provided from the application processor 4100. For example, the application processor 4100 may provide the image data to the display device 4220 such that the image obtained by the image sensor 4230 is displayed on the display device 4220.

The display device 4220 may display the image based on the image data provided from the application processor 4100. In another implementation, the display device 4220 may display the image perceived as the sensing noise based on the reference data. The display device 4220 may perform the compensation operations to compensate for the noise (sensing noise or basic noise) of the image displayed by the panel. Example compensation operations of the display device 4220 are described with reference to FIGS. 1 to 11, and thus, repeated descriptions thereof will be omitted.

The DSI host 4120 may communicate with a DSI device 4225 of the display device 4220 based on the DSI. A serializer SER may be implemented in the DSI host 4120. A de-serializer DES may be implemented in the DSI device 4225.

The CSI host 4130 may communicate with a CSI device 4235 of the image sensor 4230 based on the CSI. The de-serializer DES may be implemented in the CSI host 4130, and the serializer SER may be implemented in the CSI device 4235.

The electronic device 4000 may further include a radio frequency (RF) chip 4240 that communicates with the application processor 4100. The RF chip 4240 may include a physical layer 4242, a DigRF slave 4244, and an antenna 4246. For example, the physical layer 4242 of the RF chip 4240 and the physical layer 4140 of the application processor 4100 may exchange data with each other by the DigRF interface proposed by the MIPI federation.

The electronic device 4000 may further include a DRAM 4250 and storage 4255. The DRAM 4250 and the storage 4255 may store data provided from the application processor 4100. In addition, the DRAM 4250 and the storage 4255 may provide the stored data to the application processor 4100.

The electronic device 4000 may communicate with an external device/system through a communication module such as a worldwide interoperability for microwave access (WIMAX) 4260, a wireless local area network (WLAN) 4262, an ultra-wideband (UWB) 4264, or the like. The electronic device 4000 may include a speaker 4270 and a microphone 4275 for processing voice information. The electronic device 4000 may include a global positioning system (GPS) device 4280 for processing location information.

By way of summation and review, a display device may generate light using various elements. For example, an organic light emitting diodes (OLED) display device may generate light by electroluminescence. The OLED display device may have a relatively simple configuration, and may be designed to be thin and consume only a small amount of power. Thus, the OLED display device may be included in various mobile devices.

Reducing noise of an image that is displayed by the OLED display device may improve performance of the OLED display device. To reduce the noise of the image displayed by the OLED display device, the OLED display device may include various IPs.

As described above, embodiments relate to an electronic device that compensates a pixel value of an image such that a user is less likely to perceive noise in an image.

Embodiments may provide an electronic device that senses a pixel value of an image to be displayed, and compensates for the pixel value of the image based on the sensed pixel value.

According to an example embodiment, when an image is displayed by an electronic device, noise perceived by a user may be decreased.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An electronic device, comprising:

a display driver integrated (DDI) circuit configured to output reference pixel values to be used to obtain target pixel values of a first line, and to output image pixel values associated with a target image; and a panel circuit configured to include the first line that includes pixels configured to display a reference image having the target pixel values, based on the reference pixel values, and a second line that includes pixels configured to display an image corresponding to the target image, based on the image pixel values, wherein the DDI circuit is further configured to compensate for the image pixel values based on differences between the image pixel values and the reference pixel values, and wherein the DDI circuit is further configured to receive a signal corresponding to a displayed image from the panel circuit using the reference pixel values, and to obtain the target pixel values based on the signal received from the panel circuit.

2. The electronic device as claimed in claim 1, wherein, when the reference image is displayed by the first line during a first frame, the DDI circuit is further configured to compensate for image pixel values that are output to the first line during a second frame after the first frame.

3. The electronic device as claimed in claim 1, wherein the DDI circuit is further configured to output image pixel values that correspond to a plurality of lines including the second line.

4. The electronic device as claimed in claim 3, wherein the DDI circuit is further configured to compensate the image pixel values corresponding to the plurality of lines based on differences between the image pixel values corresponding to the plurality of lines and the reference pixel values.

5. The electronic device as claimed in claim 4, wherein the DDI circuit is further configured to determine a number of the plurality of lines.

6. The electronic device as claimed in claim 1, wherein the DDI circuit is further configured to determine the first line of a plurality of lines that are included in the panel circuit.

7. The electronic device as claimed in claim 6, wherein the DDI circuit is further configured to schedule an order for determining the first line of the plurality of lines.

8. The electronic device as claimed in claim 1, wherein the DDI circuit is further configured to store the reference pixel values.

9. The electronic device as claimed in claim 1, wherein the DDI circuit is further configured to generate compensation pixel values that are added with the image pixel values based on the differences.

10. The electronic device as claimed in claim 9, wherein the DDI circuit is further configured to output sums of the image pixel values and the compensation pixel values as compensated image pixel values.

11. The electronic device as claimed in claim 1, wherein the DDI circuit is configured to obtain the target pixel values during a first reference time.

12. The electronic device as claimed in claim 11, wherein the panel circuit is configured to display the image corresponding to the target image, based on the image pixel values, during a second reference time shorter than the first reference time.

13. The electronic device as claimed in claim 1, wherein the DDI circuit is further configured to obtain the target pixel values, which are digital values, based on analog values associated with the reference image.

14. An electronic device, comprising:

a display driver integrated (DDI) circuit configured to schedule an order for determining target pixels to be sensed from among a plurality of pixels, output reference pixel values to the target pixels, and output image pixel values representing a target image; and a panel circuit configured to display noise, based on the reference pixel values, and to display an image corresponding to the target image, based on the image pixel values, wherein the DDI circuit is further configured to compensate for the image pixel values based on differences between the reference pixel values and the image pixel values, and to perform at least one of:

increasing the image pixel values when pixel values of the noise are less than the image pixel values, and decreasing the image pixel values when pixel values of the noise are greater than the image pixel values.

15. The electronic device as claimed in claim 14, wherein, when a frame in which the noise is displayed precedes a frame in which the image corresponding to the target image is displayed, the DDI circuit is configured to compensate for the image pixel values to be output to the target pixels, and when the frame in which the noise is displayed is the same as the frame in which the image corresponding to the target image is displayed, the DDI circuit is configured to compensate the image pixel values that are output to pixels different from the target pixels among the plurality of pixels.

16. An electronic device, comprising:

a display driver integrated (DDI) circuit configured to output a reference pixel value to a first pixel and compensate for a first image pixel value to be output to a second pixel, based on the reference pixel value during a first frame, and configured to compensate for a second image pixel value to be output to the first pixel, based on the reference pixel value during a second frame after the first frame; and a panel circuit including the first pixel configured to display noise, based on the reference pixel value during the first frame and to display a first compensation image, based on the second image pixel value during the second frame, and the second pixel configured to display a second compensation image, based on the first image pixel value during the first frame, wherein a pixel value of the noise is different from a pixel value of the first compensation image, and the pixel value of the noise is different from a pixel value of the second compensation image.

17. The electronic device as claimed in claim 16, wherein the DDI circuit is further configured to compensate for the first image pixel value based further on a difference between the reference pixel value and the first image pixel value.

18. The electronic device as claimed in claim 16, wherein the DDI circuit is further configured to compensate for the image pixel values to be output to the second pixel based on differences between the reference pixel value and the image pixel values to be output to the second pixel during a plurality of frames after the first frame, and wherein a number of the plurality of frames is determined by the DDI circuit.

* * * * *